US006799517B1

(12) United States Patent
Cahill

(10) Patent No.: US 6,799,517 B1
(45) Date of Patent: Oct. 5, 2004

(54) MIXED MINE ALTERNATIVE SYSTEM

(75) Inventor: Peter J. Cahill, Fairfax Station, VA (US)

(73) Assignee: BRTRC Technology Research Corporation, Fairfax, VA (US)

( * ) Notice: Subject to any disclaimer, the term of this patent is extended or adjusted under 35 U.S.C. 154(b) by 85 days.

(21) Appl. No.: 09/805,569

(22) Filed: Mar. 14, 2001

Related U.S. Application Data

(60) Provisional application No. 60/189,083, filed on Mar. 14, 2000.

(51) Int. Cl.[7] ..... F42B 23/00

(52) U.S. Cl. ..... 102/401; 102/425; 102/427; 102/402

(58) Field of Search ..... 89/1.11, 1.13; 102/401, 402, 425, 427; 362/99, 118; 324/329

(56) References Cited

U.S. PATENT DOCUMENTS 4,576,093 A * 3/1986 Snyder
4,712,479 A * 12/1987 Babel ..... 102/427
4,860,658 A * 8/1989 Lindstadt et al. ..... 102/427
4,884,506 A * 12/1989 Guerreri
5,001,985 A * 3/1991 Reid et al. ..... 102/427
5,136,949 A * 8/1992 Grosch
5,142,986 A * 9/1992 Gundel ..... 102/401
5,307,272 A * 4/1994 Butler et al.
5,371,502 A * 12/1994 Dittmann
5,489,909 A * 2/1996 Dittmann et al.
6,014,932 A * 1/2000 Mardirossian
6,422,145 B1 * 7/2002 Gavrilovic et al.

OTHER PUBLICATIONS

Human Rights Watch Backgrounder. [online]. HRW, Apr. 2000 (retrieved Oct. 07, 2002). Retrieved from the internet: <URL:www.hrw.org/press/2000/04/us–landmines.htm>.*

Information & Electronic Warfare Systems News. RATTLER is landmine Alternative. BAE Systems, vol. II, No. 2 (Feb. 12, 2001), p. 1.*

Land Mine Primer. (online). World Equipment Guide, Nov. 2000 (retrieved Oct. 7, 2002). Retrieved from the internet: <www.google.com>.*

Jody Williams. It'S TIme to Sign Landmine Treaty. Record, Dec. 9, 1998. Bergen County, N.J..*

Landmines: White House Fact Sheet. White House Factsheet on Ottawa Convention. (online). Feb. 1999 (retrieved Oct. 07, 2002).*

* cited by examiner

*Primary Examiner*—Michael J. Carone
*Assistant Examiner*—L. Semunegus
(74) *Attorney, Agent, or Firm*—James Creighton Wray; Meera P. Narasimhan

(57) ABSTRACT

The Mixed Mine Alternative (MMA) System is a military system designed for use in mechanized warfare. The MMA System has three components, MMA smart Antitank mines, MMA Antihandling Sensors linked to the MMA smart Antitank mines, and MMA Remote Control Units (RCU). The MMA smart Antitank (AT) mines contain a primary sensor system hardened against countermeasures and a kill mechanism similar to existing scatterable AT mines. The MMA AT mine is capable of transmit and receive communications with a Remote Control Unit and with the MMA Antihandling Sensors (AH). The communications capabilities and processors in the MMA AT and the MMA AH allow the system to establish MMA AT to MMA AH links after the mines have been scattered. MMA AT will be linked to MMA AH that are within their lethal radius. The MMA AT mine processors allow the mine primary antitank sensor to be on or off. The mine may receive and act on detonate instructions from the primary antitank sensor, from the antihandling sensors, or from the MMA RCU. If in an off status the MMA AT mine may relay the detonate signal received from an MMA AH sensor to the RCU. The RCU includes a computer that maintains status information on the mines. Receipt of a relayed AH sensor detonate signal provides situational awareness information that the RCU brings to the user's attention on the screen and with an audible and/or visual signal.

90 Claims, 1 Drawing Sheet

MIXED MINE ALTERNATIVE SYSTEM

This application claims the benefit of U.S. Provisional Application No. 60/189,083, filed Mar. 14, 2000.

BACKGROUND OF THE INVENTION

Many systems exist today to produce mixed mine fields. The term mixed refers to the inclusion of both Antitank (AT) and Antipersonnel (AP) mines in the systems. The primary purpose of those systems is to destroy tanks and other armored vehicle in a mechanized force. The AT mines provide this capability. Because the minefield is deadly to vehicles that attempt to move through it, a force encountering a minefield is often delayed as it attempts to breach the minefield or to find its boundaries. If possible the force will attempt to go around the minefield, thus the element employing the mines can influence the maneuver options of their opponents. Again the AT mines are the component that give the minefield its delay and deterrent effects.

AP mines protect the AT mines by killing or deterring the threat of dismounted soldiers, thereby preventing them from creating a breach through the minefield by destroying or removing the AT mines. Early mine systems, often referred to as conventional mines, were buried mines that were placed in precise patterns, whose locations were recorded to facilitate removal after the war. The U.S. still employs conventional mines in the Demilitarized Zone between North and South Korea. Buried mines are difficult to detect, and thus are inherently difficult to breach. Most conventional mines have simple pressure fuses and contain no electronics.

Due to the extensive time and logistical effort involved with conventional mines, the U.S. developed its family of scatterable mines in the 1970's and 1980's. Scatterable mines are dispersed in random patterns on the surface. Advances in kill mechanisms and electronic fuses allow scatterable mines to achieve a high degree of lethality with a mine that is much smaller than a conventional mine. Because the scatterable mine is exposed on the surface it is easy for a dismounted, i.e., walking, soldier to detect nearby mines. All U.S. mixed mine systems are composed of scatterable AT and AP mines.

The precise location of mines in a scatterable minefield cannot be determined and recorded for future removal. Thus, the scatterable mines are designed to destroy themselves (self-destruct) after a predetermined short time period. The existing mixed mine systems are a very effective complement to other weapons systems in both offensive and defensive combat.

As long as the AP systems are present, the AT mines scattered on the surface of the ground are difficult to breach. In the absence of the AP mines, dismounted soldiers may easily breach surface laid (scattered) AT mines. For example, the soldiers can move quickly through the AT only minefield placing a small explosive charge on or near each AT mine. The deficiency this invention overcomes is caused by a desire to eliminate all AP mines without reducing the effectiveness of the mixed minefield.

The large number of civilian casualties caused by AP mines long after conflicts have ended (estimated by the United Nations at 10,000 annually) led to a worldwide movement to eliminate AP mines, which resulted in the Ottawa Convention. The Ottawa treaty was signed in 1997. Nations that ratify this treaty agree to prohibit the use, stockpiling, production, and transfer of AP landmines and to destroy all AP mines in their possession.

The United States has maintained that U.S. AP mines were not the cause of the civilian casualties since the AP mines in U.S. mixed mine systems self-destructed during or shortly after the battle and thus could not cause civilian casualties after the war. The U.S. considered the combat capability provided by its mixed mine systems to be essential to reducing U.S. casualties in the event of a conflict. The U.S. however wanted to be able to be compliant with the Ottawa treaty. The dilemma is how to preserve the effectiveness of mixed systems while eliminating the AP mine.

Since 1997, the U.S. has been unsuccessful in finding or developing an alternative to mixed mine systems. This in itself validates the lack of any existing invention that performs the functions of the MMA system. The U.S. Department of Defense published a Broad Agency Announcement on Feb. 2, 2000, seeking alternatives to mixed mines.

U.S. forces currently have four mixed mine systems that share similar technology for both AT and AP mines. Collectively they are referred to as SCATMINES. Those systems are the Gator Mine system, which is emplaced by high speed Air Force or Navy aircraft; RADAM mines, which are emplaced by 155 mm artillery; Volcano mines, which are emplaced by helicopter or ground vehicle mounted volcano delivery systems; and MOPMS, which is a small footlocker sized container that on command launches a mix of AT and AP mines to form a small minefield near the launcher.

All of the SCATMINES have self-destruct times of 4 hours to 15 days dependent on the system and the settings on the mine at launch. The MOPMS is capable of receiving a signal to recycle its self-destruct time, thereby extending its life. The U.S. Army has articulated a need to be able to remotely turn mines off and on, and to destroy them with a remote command. Those capabilities do not exist in existing mine systems.

SUMMARY OF THE INVENTION

The Mixed Mine Alternative (MMA) System is a military system designed for use in mechanized warfare. The MMA System is composed of three components, MMA smart Antitank mines, MMA Antihandling Sensors linked to the MMA smart Antitank mines, and MMA Remote Control Units (RCU).

The MMA smart Antitank (AT) mines contain a primary sensor system hardened against countermeasures and a kill mechanism similar to existing scatterable AT mines. The MMA AT mine's communication capability is significantly greater than any existing mine. The MMA AT mine is capable of transmit and receive communications with a Remote Control Unit and with the MMA Antihandling Sensors (AH). Communications in existing mines are capable of receive only.

The communications capabilities and processors in the MMA AT and the MMA AH allow the system to establish MMA AT to MMA AH links after the mines have been scattered. MMA AT will be linked to MMA AH that are within their lethal radius. The MMA AT mine processors allow the mine primary antitank sensor to be on or off. The mine may receive and act on detonate instructions from the primary antitank sensor, from the antihandling sensors, or from the MMA RCU. If in an off status the MMA AT mine may relay the detonate signal received from an MMA AH sensor to the RCU. The RCU includes a computer that maintains status information on the mines. Receipt of a relayed AH sensor detonate signal provides situational awareness information that the RCU brings to the user's attention on the screen and with an audible signal.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
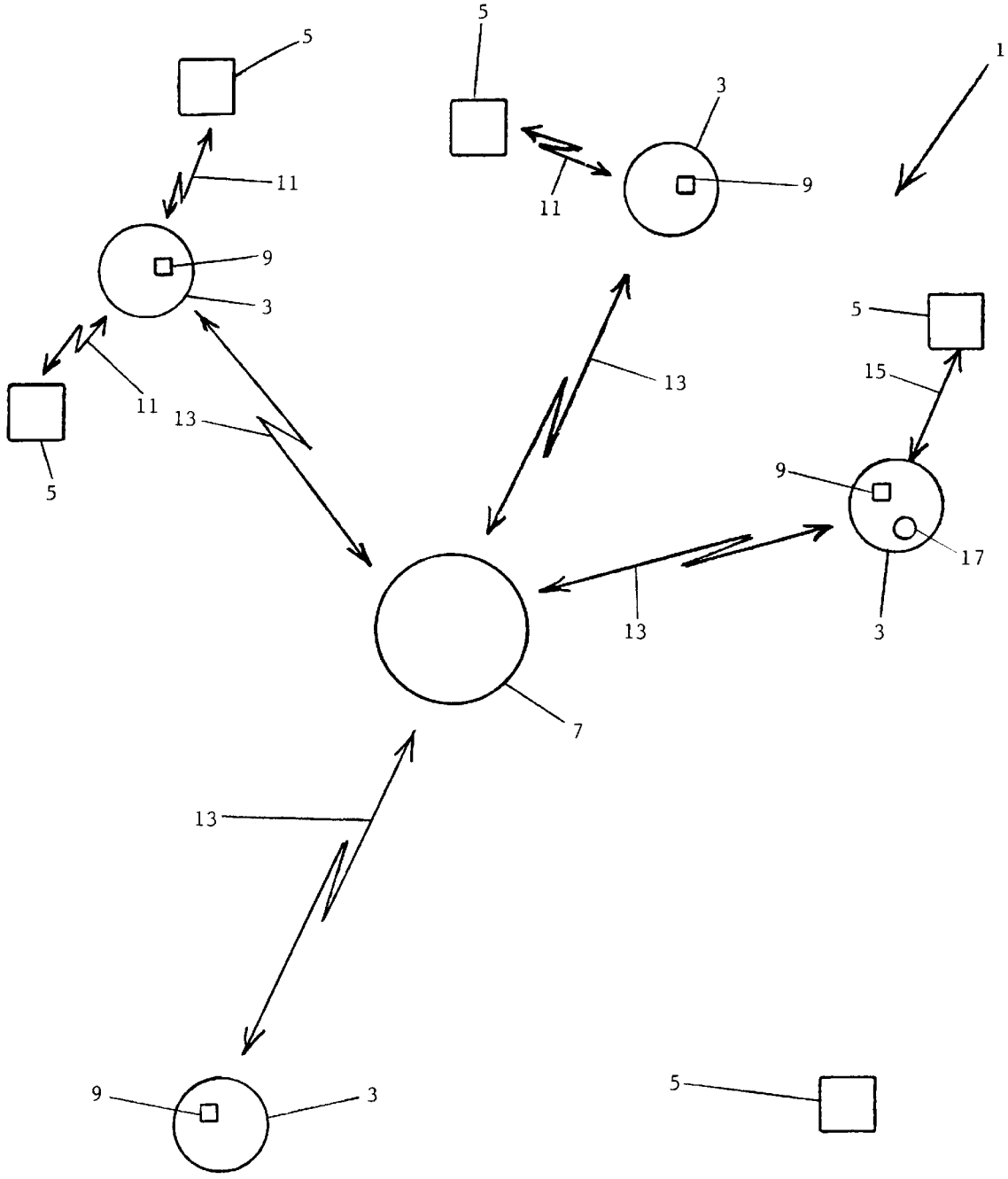
FIG. 1 is a schematic representation of the mixed mine alternative (MMA) system of the present invention.

The Mixed Mine Alternative (MMA) System 1 is a military system designed for use in mechanized warfare. The MMA System is composed of three components, MMA smart Antitank mines 3, MMA Antihandling Sensors 5 linked to the MMA smart Antitank mines, and MMA Remote Control Units (RCU) 7, as shown in FIG. 1.

The MMA smart Antitank (AT) mines 3 contain a primary sensor system 9 hardened against countermeasures and a kill mechanism similar to existing scatterable AT mines. The MMA AT mine's communication capability is significantly greater than any existing mine. The MMA AT mine 3 is capable of transmit and receive communications 11, 13 and 15 with a Remote Control Unit 7 and with the MMA Antihandling Sensors (AH) 5. Communications in existing mines are capable of receive only.

The communications capabilities and processors in the MMA AT 3 and the MMA AH 5 allow the system to establish MMA AT to MMA AH links 11 after the mines have been scattered. MMA AT 3 are linked 11 to MMA AH 5 that are within the lethal radius of the MMA AT mine. The MMA AT mine processors allow the mine primary antitank sensor 9 to be on or off. The mine 3 may receive and act on detonate instructions from the primary antitank sensor 9, from the antihandling sensors 5, or from the MMA RCU 7. If in an off status, the MMA AT mine 3 may relay the detonate signal 11 received from an MMA AH sensor 5 to the RCU 7 through a communication signal 13. The RCU 7 includes a computer that maintains status information on the mines 3. Receipt of a relayed AH sensor 5 detonate signal 11 provides situational awareness information that the RCU 7 brings to the user's attention on the screen and with an audible signal.

The Mixed Mine Alternative System 1 was developed in response to the desire of the United States Department of Defense (DoD) to eliminate anti-personnel (AP) submunitions in its mixed mine systems. Those mixed mine systems employ anti-tank (AT) mines to defeat mechanized formations and AP submunitions as a method to discourage breaching of the AT mines. The DoD requires a militarily advantageous, cost effective and safe-to-use system that meets or exceeds current strategic, tactical and effectiveness levels.

The elimination of AP submunitions is necessary because the U.S. Government desires to be in a position to be considered compliant with the Ottawa Convention by 2006. The Ottawa Convention bans the Antipersonnel Landmine (APL) for signatory states. To be compliant without degrading combat effectiveness, the United States must find effective alternatives for the APL and the AP submunitions in its mixed mine systems.

The Ottawa Convention does not ban AT mines, nor does it ban anti-handling devices on AT mines. The U.S. sought wording in the convention that would allow anti-handling devices "near" the AT mines, with a view toward using its current AP mines as these devices. In furtherance of this approach, the U.S. began packaging its artillery delivered mines into mixed systems. All other U.S. scatterable mines were already packed with APL in mixed systems. The Oslo conference rejected the U.S. proposal to add the words "or near" to the definition of anti-handling devices, thereby prohibiting a signatory state from continuing to use an anti-tank mine system that contained antipersonnel munitions.

The present invention herein is based on preserving the effectiveness of the mixed system and complying with the wording of the Ottawa Convention.

The U.S. current use of AP mines in mixed systems is based on the fact that the AT mines in these systems would be extremely vulnerable to dismounted breaching efforts were it not for the presence of AP munitions. The AT mines, which are scattered on the surface, are easily detected by a dismounted soldier who can eliminate the mine quickly through the use of simple techniques, such as placing a small explosive charge on each mine. Although minefields are often emplaced where the dismounted soldier could be engaged by observed indirect fire, the speed at which a dismounted breach can be effected may be faster than such non-dedicated fires could be brought to bear.

In current mixed systems, AP munitions perform several functions. First and foremost, they kill dismounted soldiers attempting to breach the AT mines. Second, because of this lethality, they discourage the threat from attempting a dismounted breach. As a tertiary effect they make it less likely that the threat will drive mechanized vehicles in the minefield unless they are "buttoned up"; i.e., the crews will not be partially out of the hatches, but rather will be inside the vehicles with the hatches closed. This buttoned up mode reduces the effectiveness of many potential adversaries and complicates their ability to conduct a mounted breach of the mines. Finally, the AP mine prevents dismounted soldiers from accompanying the mechanized elements in the final assaults. All of these functions are possible because the AP component of the mixed system makes the minefield a very deadly place for exposed soldiers.

The MMA system 1 continues to provide this deadly environment in the minefield without the use of AP munitions.

The Ottawa Convention definition of an APL is a mine designed to be exploded by the presence or contact of a person. The definition excludes antitank and antivehicle mines that are equipped with "anti handling". The treaty definition of an antihandling device is those "intended to protect a mine and which is a part of, linked to or placed under the mine."

The MMA system 1 entails evolutionary development of existing AT mine system capabilities, namely the ability to provide on/off and command destruct for these mines. The on/off and command destruct capabilities allows our forces to maneuver through their own minefields without fear of fratricide by the mines. This function requires that each AT mine 3 is capable of receiving a coded (for security) RF signal (to change its status) and broadcasting a response (for confirmation).

The MMA system 1 replaces the AP munitions in the mixed system with anti-handling sensors 5 that are RF 11 or hard wired 15 "linked to the AT mine". When emplaced, the sensors 5 query the AT mines 3 to determine which mines are within a short range. This range is predetermined by the use of a very low power RF link 11 unless a method such as time delay frequency response or other means to identify only those mines 3 within a short distance of the sensor 5 is possible.

Through a series of such signals and algorithms in the sensor 5, each sensor is paired to an AT mine 3 (if an AT mine is within lethal range). The algorithms allow more than one sensor 5 to be paired to a mine 3, but a sensor may only be paired to one mine, regardless of how many mines are within range of the sensor. In this configuration, there may be AT mines 3 that have no paired sensors 5, and sensors that have no paired mine. If the sensor 5 is hard wired 15 to the mine 3, the linkage/pairing is built in, thus this initial pairing is not required.

Upon sensing that handling of the AT mine is imminent; i.e., that there is a dismounted soldier within range, the sensor 5 sends a command destruct signal 11 and 15 to its paired AT mine 3. Upon receipt of this signal, if the AT mine 3 is on, the mine destructs, thereby creating the potential of lethal effects against the intruder. If the AT mine 3 is off when the sensor 5 sends its signal 11 and 15, the AT mine may retransmit this signal as signal 13 to the RCU 7. On/off is the term currently used when discussing the planned future capability of the AT mine, although actually the mine is always on so it can receive and process commands. Armed or unarmed may be more appropriate terminology. When armed, the AT magnetic signature sensor 9 of the mine is operating (on) and when unarmed this magnetic signature sensor is not operating (off). After the initial signal 11 to destruct, and an appropriate delay time, if the sensor 5 again senses a dismounted soldier, a new destruct signal 11 and 15 is broadcast. If a mine 3 that had been off for the earlier destruct signal has later been turned on, it detonates upon receipt of the subsequent destruct signal 11 and 15. A unique coding established in the pairing process insures that only one mine 3 may be set off by a disturbed sensor 5.

In addition to the coupling with the sensors, some portion of the AT mines 3 may have a built-in sensor 17 that causes a mine (if on) to detonate if moved. As with the current AT mines, these new mines incorporate a built in self-destruct time to avoid leaving lethal residue on the battlefield. If the mines were no longer needed prior to the self-destruct time, they may be command destructed. The sensors 5, containing no explosive, leave no hazardous residue. The sensors 5 are completely inert after battery run down.

The MMA system 1 uses the same delivery systems and the same external configuration and kill mechanism for the AT mine as in the current scatterable mine systems. Advances in electronics and batteries since the development of those mines in the 1970's, allows incorporation of the new features (RF links and processing) within the current AT package. The anti-handling sensor 5 may sense by trip wire, magnetic influence, motion, seismic, acoustic, or infrared. The sensors 5 are configured to withstand the emplacement environment and to disperse appropriately amongst the AT mines 3 when emplaced by the current mine delivery systems.

One concern that has emerged in the past when considering the on/off capability for the AT mine is how does the user know that the mine received and implemented the signal. The mine may respond, but the size of the mine and the competing (for space and power) functions within the mine limit the range of the response. It may be exceedingly difficult to receive acknowledgment of commands from all mines, particularly those that are remotely delivered. The Army has not been concerned if it did not receive acknowledgment from some mines that they had been turned on, as long as developmental testing verified that a high percent of the mines receive and perform the turn on function. A failure to turn off when directed, however, cannot be tolerated. How can a commander maneuver his force through a "friendly" minefield if he cannot be certain all mines are turned off? Command destruct answers some of this concern. The MMA system 1 incorporates command destruct. If a minefield is directed to destruct, then most mines 3 detonate. Any that do not are presumed to be armed and dangerous (although most mines remaining after the destruct signal may actually be duds). The downside of the command destruct approach is that if the mines were needed after the maneuver for any reason they have to be replaced.

The MMA system 1 offers another partial solution to this problem. The invention includes smart mines, operated by software (on/off status, time until self destruct, analysis of signals and initiation of actions based on this analysis, etc.) that adds something familiar to all PC users, the idea of a screen saver. When a mine is turned on, whether at emplacement or at subsequent time, a timer is started. After a preset time, the mine turns itself off. Somewhat similar to the current MOPMS and its recyclable self-destruct, the user sends a signal to recycle the "time on" period, much like hitting a key to restore the PC screen. The signal to restart this self-turnoff timer of the mine may be sent either before or after the prior cycle had expired.

Current mines have a self-test of their hardware when they arm; they self-destruct if they find a problem. The MMA AT mine 3 runs a similar test of the software each time the mine is turned on. If any aspect of the software, including the "screen saver" function, fails the test, the mine self-destructs. Thus, if a mine comes on and does not immediately self-destruct, the "screen saver" may be relied on to turn the mine off at its preset time. A unit may maneuver safely through the minefield after the preset time. At other times the commander has to rely on the command off or the command self-destruct.

Protection of the civilian population from the indiscriminant nature of mines is the driving force behind the Ottawa Convention. Those casualties primarily occur long after the battle. Although the U.S. current mixed systems leave little residual hazard after the battle, they are not treaty compliant. The MMA system further reduces the minimal residual hazard by eliminating AP munitions.

MMA also provides a way to reduce the potential hazard to civilians before and during the battle through judicious use of the on/off capability. The mines need not be turned on unless they are needed. Having the mines in place in an off mode allows early emplacement without causing a hazard to civilians or denying maneuver options to our forces. However, any decision to leave the mines off requires assessment of the risk of a surreptitious breach of the minefield while it was in the off mode. The ability of the MMA AT mine 3 that is turned off to relay 13 the MMA AH sensor 5 destruct signal 11 to the RCU 7 provides the user awareness that there is movement in the MMA minefield.

Some versions of the MMA AT mine may incorporate fusing and/or casing changes to improve the anti-handling lethality of the AT mine 3 to increase the effectiveness of the anti-handling in preventing a breach of the minefield. These methods improve the shrapnel effect of a command destructed AT mine 3.

Each mine 3 and sensor 5 requires a unique coded identifier to facilitate subsequent link-up. Mines will know which minefield they are in. The method of imparting this minefield information to the mine varies based on the emplacement system. Subsequent to emplacement, most, if not all commands, are given to all mines in a minefield simultaneously. Each minefield controller device is able to separately address individual minefields.

The employing unit may receive information from the minefield, giving the location and status of every mine. Mine status will include on/off, time remaining to off or to self destruct, and number of anti-handling sensors keyed to the mine. This information allows the unit to recognize weak points in the minefield (low density of mines or sensors) and either to add mines, preplan indirect fire concentrations, and/or provide direct fire coverage of the weakness. The ability to query the status of the mines allows the unit to evaluate the effectiveness of threat breaching attempts and to react accordingly. The precise location information allows turning mines off to create lanes for friendly maneuver, and the response from the mines verifies that the lanes had been created.

Several variants require lower degrees of information. For example, eliminating the need for a precise location of each mine reduces the cost. The general boundaries of the minefield are determined and reported by the emplacing unit. Detailed status information from each mine still facilitates most decisions. The unit knows in aggregate the number of mines in the minefield and their status. By querying, the unit may determine how many are still effective after breaching attempts. Lanes may be created through mine belts by turning off specific mine fields.

Sensors 5 distinguish movement by a soldier from other forms of movement near the sensor (animals, wind-induced motion). The sensors 5 are effective in a wide range of climatic conditions, and are not susceptible to spoofing by the threat. Sensors 5 include those that may detect and signal multiple times and to one-time sensors. Sensors 5 are low power consumers to allow long effective life.

The communications in the mines 3 are highly reliable in receiving signals 11 and 13 from the mine controller device 7 and sensors 5 that are within range. The distance from sensor 5 to mine 3 is established by the communications link. The link 11 is not susceptible to jamming or mutual interference.

Advances have been made in electronics and batteries since the fielding of the U.S. SCATMINE. The MMA system 1 incorporates these advances into the AT mine 3 together with the communications and processing discussed herein. Improved batteries allow for longer life mines 3.

While the invention has been described with reference to specific embodiments, modifications and variations of the invention may be constructed without departing from the scope of the invention, which is defined in the following claims.

I claim:

1. A mixed mine alternative (MMA) system comprising plural MMA smart antitank (AT) mines, plural MMA antihandling (AH) sensors spaced from the mines and communicating with the mines, and MMA remote control units spaced from and communicating with the mines and the antihandling sensors.

2. The system of claim 1, wherein each of the mines further comprise a primary sensor system protected against countermeasures and a kill mechanism of scatterable antitank mines.

3. The system of claim 2, wherein the mines further comprise communications electronics comprising transmitters and receivers, a remote control unit and multi-way channels of communications with the mines, the remote control unit and the antihandling sensors.

4. The system of claim 3, wherein further comprising processors communicating with the communications electronics for linking the mines after scattering, with the antihandling sensors and the remote control units.

5. The system of claim 1, wherein the mines are linked to the sensors within a lethal radius of the mines.

6. The system of claim 4, wherein the processors control on/off modes of the antihandling sensors.

7. The system of claim 6, wherein the processors receive signals from the antihandling sensors for processing and send signals to the mines for activating detonation of the mines.

8. The system of claim 7, further comprising a computing device communicating with the processors for coordinating signals indicating detonate instructions received from the antihandling sensors, responding to the signals and maintaining status information of the system.

9. The system of claim 8, further comprising situational awareness information in the device, a display connected to the device, wherein the information is provided on the display for end-users.

10. The system of claim 9, further comprising alarms connected to the system for activation by the device.

11. The system of claim 10, wherein the alarms are selected from a group consisting essentially of audible, visual, audio-visual, vibratory alarms and combinations thereof.

12. The system of claim 1, wherein the sensors are RF sensors or hard wired sensors linked to the mines.

13. The system of claim 12, wherein the sensors are emplaced for querying the mines for determining ranges of the mines.

14. The system of claim 13, wherein the sensors have links with the mines and wherein the ranges are predetermined and retained in memory.

15. The system of claim 14, wherein the links include a low power RF link for identifying only the mines within a short distance of the sensors.

16. The system of claim 14, wherein the links include a time delay frequency response measurement for identifying only the mines within a short distance of the sensors.

17. The system of claim 14, wherein the sensors further comprise a series of signals and algorithms for pairing each sensor to a mine within a lethal range.

18. The system of claim 17, wherein the algorithms allow pairing of more than one sensor to the mine.

19. The system of claim 14, wherein the sensor is paired to one mine within a range of the sensor, wherein some of the sensors have no paired mines and wherein some of the mines have no paired sensors.

20. The system of claim 14, wherein the links comprise a hard wired linkage/pairing in the mine for linking a sensor to the mine.

21. The system of claim 14, further comprising sensed signals generated by the sensors on sensing an intruder within a predetermined range, and command destruct signals responsive to the sensed signals from the sensors for destructing a linked mine and causing lethal effects on the intruder within the range.

22. The system of claim 21, wherein the command destruct signals are regenerative in response to plural intruders.

23. The system of claim 22, further comprising means for detonating one mine responsive to a disturbed sensor.

24. The system of claim 1, wherein each mine further comprises means for self-destruction after a predetermined time.

25. The system of claim 24, wherein the means include remote command devices for remotely triggering destruction of the mine.

26. The system of claim 24, wherein the mines and sensors are inert and residue-free after destruction.

27. The system of claim 1, wherein the sensors include sensing means selected from a group consisting essentially of trip wire, magnetic influence, motion, seismic, acoustic, or infrared and combinations thereof.

28. The system of claim 1, further comprising command destruct signals generated by the system for detonating the mines within a given range responsive to remotely issued commands.

29. The system of claim 1, wherein the mines are smart mines comprising software for controlling all operations of the mines and for maintaining the mines in an on/off status corresponding to use/non-use of the mines.

30. The system of claim 29, further comprising a self-turnoff timer communicating with the mines for selectively controlling operation of the mines.

31. The system of claim 29, wherein the software further comprises a self-testing property for controlling operation of the mines in the even of failure of an aspect of the software.

32. The system of claim 1, wherein each mine and each sensor comprises a unique coded identifier for facilitating subsequent link-up and for identifying mines within particular minefields.

33. The system of claim 32, further comprising minefield controller devices communicating with the minds for separately addressing individual mines or minefields.

34. The system of claim 1, wherein the sensors comprise means for distinguishing movements by a soldier from other forms of movement proximal the sensor.

35. The system of claim 1, wherein the sensors are weather-proof and climate-proof.

36. The system of claim 1, further comprising a power source communicating with the system for supplying power.

37. A mixed mine alternative (MMA) mining process for mechanized warfare comprising providing plural, spaced MMA smart antitank (AT) mines in a desired zone, providing plural, spaced MMA antihandling (AH) sensors, linking the plural AH sensors to the plural AT mines, providing MMA remote control units, linking the remote control units to the plural AT mines and the plural AH-I sensors.

38. The process of claim 37, further comprising supplying power to the system with a power supply.

39. The process of claim 37, further comprising providing a primary sensor system in each of the mines and foolproofing the antihandling sensors against countermeasures.

40. The process of claim 39, further comprising transmitting and receiving signals and communications from the primary sensor system and communicating with the remote control unit and with the antihandling sensors.

41. The process of claim 40, further comprising providing communication links between a processor and the mines, the antihandling sensors and the remote control units.

42. The process of claim 41, further comprising linking sensors to the mines within a lethal radius of the sensors.

43. The process of claim 41, wherein the providing communication links comprises allowing the processors to retain the mines in on/off modes.

44. The process of claim 41, further comprising providing instructions to the mines as detonate signals from the primary antitank sensor, the antihandling sensors, and/or the remote control unit.

45. The process of claim 17, wherein the providing the instructions comprises relaying the detonate signals to the remote control unit if the mines are in an off status.

46. The process of claim 44, wherein the providing instructions comprises providing a computing device for processing information and signals received and responding to the processing by communicating with the mines, the antihandling sensors and the remote control unit and maintaining status information on the mines.

47. The process of claim 46, further comprising receiving a relayed detonate signal from the antihandling sensors and providing situational awareness information to the remote control unit and displaying the information on a display.

48. The process of claim 47, further comprising providing an alarm signal responsive to the information when necessary.

49. The process of claim 37, wherein the MMA mining process is employed to defeat mechanized formations and submunitions as a for discouraging breaching of the mines.

50. The process of claim 49, further comprising effecting lethal injury to dismounted soldiers breaching the mines thereby discouraging threats from intruders, discouraging entry of mechanized vehicles in the zones unless crews are inside the vehicles with closed hatches, reducing effectiveness potential of adversaries, complicating abilities to conduct a mounted breach of the mines, and preventing dismounted intruders from accompanying the vehicles in final assaults.

51. The process of claim 37, further comprising providing commands for on/off status of mines and for destructing the mines.

52. The process of claim 51, further comprising encoding the mines, activating the encoding by signals for changing the status of the mine, and for broadcasting a response to the activation.

53. The process of claim 52, further comprising linking the mines with the sensors by RF links or by hard wiring the mines.

54. The process of claim 53, further comprising emplacing the sensors and querying the status of the mines for determining a range of the mines.

55. The process of claim 53, further comprising determining a range of the mines by time delay frequency response.

56. The process of claim 54, further comprising providing algorithms in the sensors, and selectively pairing one or more sensors to each mine in a lethal range through a series of signals.

57. The process of claim 56, wherein the pairing comprises pairing only one mine to a predetermined sensor.

58. The process of claim 56, wherein the pairing comprises providing sensors without paired mines and mines without paired sensors in a series.

59. The process of claim 56, further comprising sensing handling of a mine by an intruder within a range, sending sensed signals to the sensors, receiving a command destruct signal and communicating the command destruct signal to a mine within the range.

60. The process of claim 59, further comprising effecting a self-destruction of the mine thereby creating lethal effects against the intruder.

61. The process of claim 59, wherein receiving the signal by the mine comprises sensing the on/off status of the mine, and retransmitting the signal to the remote control unit if the mine is in off status.

62. The process of claim 59, further comprising a magnetic signature sensor in the mine in operating or on mode and not operating or off mode.

63. The process of claim 59, wherein the communicating the command destruct signal comprises relaying an initial signal destruct, allowing for an appropriate delay time, sensing again another intruder, relaying a new destruct signal and broadcasting the signal, turning on a mine in off status for the earlier destruct signal and detonating said mine on receiving the new destruct signal.

64. The process of claim 63, further comprising providing a unique coding for pairing a sensor with a mine, and ensuring that only one mine is detonated by the paired sensor in a range sensing the intruder.

65. The process of claim 37, further comprising providing a built-in sensor in each mine to detonate the mine when moved.

66. The process of claim 37, further comprising incorporating a built in self-destruct time in the mines to prevent lethal residue remaining on the battlefield.

67. The process of claim 66, further comprising command destructing the mines no longer needed prior to the self-destruct time.

68. The process of claim 37, wherein providing the sensors comprises providing sensors that become inert after battery run down for preventing hazardous residue remaining behind.

69. The process of claim 37, wherein providing the sensors comprises providing sensors with sensing capabilities selected from a group consisting of trip wires, magnetic influence, motion, seismic, acoustic, or infrared, and combinations thereof.

70. The process of claim 37, wherein the providing the mines comprises providing smart mines, operating the smart mines by software to provide on/off status, time until self destruct, analysis of signals and initiation of actions based on this analysis.

71. The process of claim 70, further comprising turning on the mines, starting a self-turnoff timer, turning off the mines after a preset time, and sending user signals to the mines to recycle a "time on" period for the timer either before or after expiration of a prior cycle.

72. The process of claim 71, further comprising providing a self-tester in the mines for self-testing, detecting a problem with the self-tester, and detonating the mine if the problem is detected.

73. The process of claim 37, further comprising providing each mine and each sensor with a unique coded identifier and facilitating link-up of the mines, the sensors and the remote control unit.

74. The process of claim 73, further comprising providing controller devices for the mines and determining locations of the mines in respective minefields.

75. The process of claim 74, further comprising emplacing the mines through the controller device and the sensors, imparting minefield information to the mines, and sending commands to the mines in the minefield simultaneously.

76. The process of claim 74, wherein providing controller devices comprises separately addressing individual minefields with each minefield controller device.

77. The process of claim 76, further comprising providing emplacing units for the minefields and receiving information from the minefield for determining location and status of each mine.

78. The process of claim 77, wherein the determining location and status comprises determining and providing mine positions, on/off status, time remaining to turn off, time remaining to self destruct, and numbers of the sensors keyed to the mine.

79. The process of claim 78, further comprising deterring weak points in the minefield from the determining of the status, recognizing low density of mines or sensors and adding mines where required, preplanning indirect fire concentrations, and/or providing direct fire coverage of weak points.

80. The process of claim 79, wherein the deterring the status comprises evaluating effectiveness of threats, breaching attempts and reacting appropriately by providing preventive measures.

81. The process of claim 80, wherein the determining comprises precisely locating information about the mines, selectively turning the mines off, creating lanes for friendly maneuver, and verifying responses from the mines to confirm the lanes are created.

82. The process of claim 77, further comprising determining general boundaries of the minefield by the emplacing unit.

83. The process of claim 82, further comprising determining an aggregate number of the mines in the minefield and determining status of the mines.

84. The process of claim 83, further comprising querying the emplacing unit for determining active mines in the range and for creating lanes through mine belts by turning off specific mine fields.

85. The process of claim 77, further comprising selectively sensing presence of intruders and distinguishing intruders from other forms of movement caused by animals or wind.

86. The process of claim 37, further comprising climate- and weather-proofing the sensors for effectively functioning in a wide range of climatic conditions.

87. The process of claim 37, wherein providing the sensors comprises detecting intrusions and providing signals multiple times with multiple-time sensor or once with a single-time sensor.

88. The process of claim 37, further comprising providing communications links, fool-proofing the communication links in the mines for receiving signals from a mine controller device and the sensors within a range.

89. The process of claim 88, further comprising determining distances from the sensors to the mines by the communications link.

90. The process of claim 89, further comprising preventing the links from jamming and from mutual interferences.

* * * * *

UNITED STATES PATENT AND TRADEMARK OFFICE

CERTIFICATE OF CORRECTION

PATENT NO. : 6,799,517 B1
DATED : October 5, 2004
INVENTOR(S) : Peter J. Cahill

It is certified that error appears in the above-identified patent and that said Letters Patent is hereby corrected as shown below:

Column 9,
Line 35, change "AH-I" to -- AH --.

Signed and Sealed this

Thirteenth Day of September, 2005

JON W. DUDAS
*Director of the United States Patent and Trademark Office*